United States Patent [19]

Gardner

[11] 4,044,923

[45] Aug. 30, 1977

[54] FOAM GENERATING DISPENSER HAVING A MOVABLE AND STATIONARY POROUS ELEMENT

[75] Inventor: Jack C. Gardner, College Park, Ga.

[73] Assignee: Glasrock Products, Inc., Fairburn, Ga.

[21] Appl. No.: 687,762

[22] Filed: May 19, 1976

[51] Int. Cl.[2] ..... B65D 37/00; B67D 5/58

[52] U.S. Cl. ..... 222/190; 222/211; 239/343

[58] Field of Search ..... 239/326, 327, 343; 222/189, 190, 211

[56] References Cited

U.S. PATENT DOCUMENTS

| | | | |
|---|---|---|---|
| 3,622,049 | 11/1971 | Thompson | 239/327 X |
| 3,937,364 | 2/1976 | Wright | 222/190 |
| 3,985,271 | 10/1976 | Gardner | 222/190 |

FOREIGN PATENT DOCUMENTS

| | | | |
|---|---|---|---|
| 457,308 | 7/1968 | Switzerland | 239/326 |

*Primary Examiner*—Drayton E. Hoffman
*Assistant Examiner*—David A. Scherbel
*Attorney, Agent, or Firm*—Lane, Aitken, Dunner & Ziems

[57] ABSTRACT

An improved nozzle assembly for manually actuated foam generating and dispensing units in which a tapered bottle cap fitted at its interior end with a dip tube subassembly, is provided with a movable porous element which, upon discharge of foam from the dip tube subassembly, effects a further reduction in bubble size in the foam thereby to provide a stiffer and more consistent foam. The movable porous element floats in the nozzle between a position of seating against the tapered internal nozzle surfaces and a retracted position allowing air to return about the member back to the interior of the generating and dispensing unit.

11 Claims, 3 Drawing Figures

FOAM GENERATING DISPENSER HAVING A MOVABLE AND STATIONARY POROUS ELEMENT

BACKGROUND OF THE INVENTION

This invention relates to manually actuated foaming devices and more particularly, it concerns an improved foamer nozzle construction for use with collapsible bottles containing foamable liquid and air.

In my co-pending application Ser. No. 584,610 filed June 6, 1975, now U.S. Pat. No. 3,985,271 there is disclosed a foam generating and dispensing device in which the discharge passageway of a cap adapted to be attached to a collapsible bottle containing foamable liquid and air is fitted with a porous element of rigid polymeric material having structural characteristics enabling direct support of a dip tube from the element as well as the formation in the element of a return air passageway and valve seat for a one-way ball check. The valve seat is spaced sufficiently from the end of the dip tube such that upon forcible collapse of the bottle to pressurize it contents, air or liquid, depending on the vertical orientation of the bottle, is caused to pass through the dip tube and outwardly into the porous element to be mixed with liquid (or air) passing directly through the element and discharged through the cap as foam. Upon relaxing the force collapsing the bottle, a negative pressure within the bottle is balanced with atmospheric pressure by return passage of air past the ball check, through the dip tube and to the bottle interior. A similar type of foam dispensing device is disclosed in U.S. Pat. No. 3,937,364 issued Feb. 10, 1976 to Herschel Earl Wright, though in this instance, the chamber and seat for the ball check valve is established by a tubular component separate from the porous element, itself.

Manually actuated foam dispensers of the type disclosed in the aforementioned references represent viable commercial candidates because of their effectiveness in achieving the desired intermixture of air and liquid at low pressures and also because of low manufacturing costs. In this latter respect, the foam generating components, namely, the porous block, dip tube and ball check, represent a three part subassembly which is capable of being press fit or otherwise secured directly in the interior large end of a standard tapered or frusto-conical nozzle on a premolded cap which, when secured to a collapsible bottle, provides the complete foam generating and dispensing unit.

A major problem with manually actuated foam dispensing devices, including those of the type aforementioned, is the attainment of a predictably uniform and preferably stiff consistency in the discharged foam while at the same time avoiding such resistance to fluid flow from the foamer as would require excessive application of force to collapse the bottle containing the foamable liquid and air. Consistency and foam stiffness turn largely on reducing to a minimum, bubble size in the foam, a factor in turn predicated on the size of passageways through which the liquid and air are passed for intermixing. Thus, it will be appreciated that optimizing the desirable characteristics in the foam is inconsistent with reduction of foam dispensing pressures. Optimum results with manual foaming devices are achieved, therefore, only by a careful correlation of the foamer components. In particular, the porous element through which the liquid and air are passed for mixing must be matched with the liquid used to produce the foam.

In addition, the development of a stiff foam, in which bubble size is minimized, enlarges the problems associated with the return of air to the bottle interior during each foaming cycle. In foamers of the aforementioned type, for example, that portion of the cap discharge nozzle extending beyond the porous block will be filled with foam at the time the bottle collasping force is released and the foam in the nozzle will resist the return of air through the ball check valve chamber in the porous block and dip tube to the interior of the bottle.

SUMMARY OF THE PRESENT INVENTION

In accordance with the present invention, operation of the aforementioned type of foamer is substantially improved without corresponding cost increase by positioning an additional moving or floating porous element in the tapered or frusto-conical portion of the discharge nozzle ahead of or downstream from the fixed porous block component of the dip tube - ball check subassembly. On the discharge of foamable liquid and air through the fixed porous block, the movable or floating porous element will advance against the frusto-conical surfaces of the discharge nozzle and function to additionally break-up or reduce bubble size in the foam to be dispensed. Upon relaxation of the collapsible bottle to establish a pressure in the bottle interior less than atmospheric, air returning to the bottle interior will unseat the floating porous element in a manner such that the path of resistance to return air is minimized. The floating porous element can be any of several acceptable configurations selected to optimize the formation of foam for a given foamable liquid without changing the physical characteristics (eg. pore size and density) of the porous polymeric material from which the floating element is made. From a manufacturing standpoint, adaptation of a particular foamer to a particular foamable liquid is facilitated by selecting a floating porous element of an appropriate shape without need for changing the fixed porous element of the dip tube - ball check subassembly. Multiples of variations may be accomodated through the use of other visible indicia such as color coding floating elements formed of polymeric materials having different physical characteristics.

Among the objects of the present invention are therefore: the provision of an improved nozzle assembly for manually actuated foam generating and dispensing devices; the provision of such an improved nozzle assembly particularly adapted for use with foam dispensers of the type in which fluids constituting the foam to be dispensed are passed through a porous block fixed in the mouth of a tapered discharge nozzle; the provision of such an improved nozzle assembly by which manufacturing assembly specifications for specific foamable liquids can be readily accomodated; the provision of such an improved foaming nozzle by which obstruction of air return through the nozzle is minimized; and the provision of such an improved foam dispensing nozzle assembly which is directly adaptable to existing foamer structures.

Other objects and further scope of applicability of the present invention will become apparent from the detailed description to follow taken in conjunction with the accompanying drawings in which like reference numerals designate like parts.

DETAILED DESCRIPTION OF THE PREFERRED EMBODIMENTS

Figure 2:
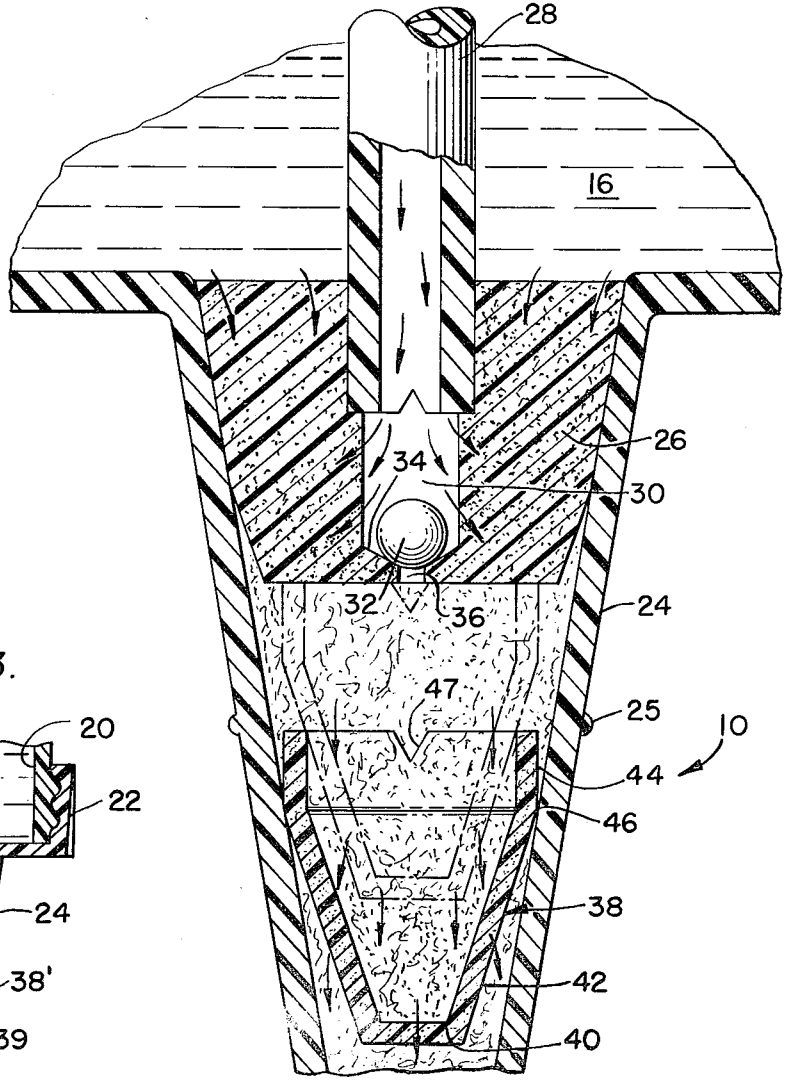
FIG. 2 is an enlarged vertical section of the area within the sight circle 2 of FIG. 1.
Figure 1:
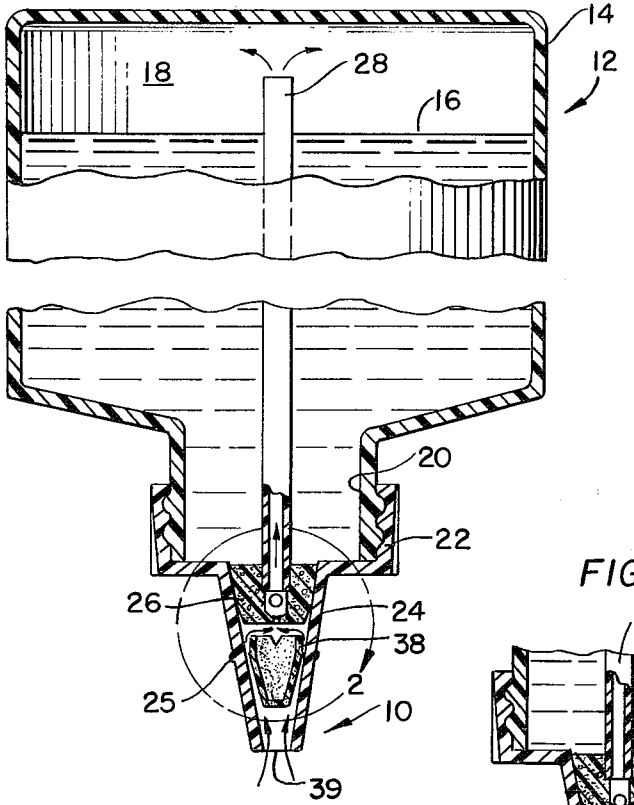
FIG. 1 is a fragmentary vertical section illustrating a manually actuated foam dispensing unit equipped with the improved nozzle structure of the present invention.

In FIGS. 1 and 2 of the drawings, a preferred embodiment of the improved nozzle assembly of the present invention is designated generally by the reference numeral 10 and shown in a manually actuated foam generating and dispensing unit 12 including a conventional collapsible bottle 14 partially filled with foamable liquid 16, the remainder being filled with air 18. The mouth 20 of the bottle is fitted with a conventional threaded cap 22 having a tapered or frusto-conical discharge nozzle 24 provided with an exterior rib 25 for engaging a closure cap (not shown). In accordance with the teaching of the aforementioned co-pending application Ser. No. 584,610 filed June 6, 1975, the inner or large end of the nozzle 24 is fitted with a fixed porous element 26 of rigid polymeric material supporting an imperforate dip tube 28 which extends from the porous block to the vertical extremity of the bottle 14 opposite the mouth 20. A valve chamber 30 is formed in the fixed porous element 26 as an extension of the dip tube 28. A ball check 32 is contained in and movable between opposite ends of the valve chamber defined respectively by the outer end of the dip tube 28 and by a valve seat 34 communicating with an air return passageway 36.

As disclosed in the aforementioned co-pending application, a foam generating and dispensing unit having the described components is operated by squeezing the bottle 14, preferably while holding it in the inverted orientation shown in FIG. 1, such that internal pressure developed by collapse of the bottle will force the liquid 16 into the body of the fixed porous block 26 and simultaneously discharge air through the dip tube 28. Because of the seated condition of the ball check 32, the air passing through the dip tube will be forced outwardly into the body of the fixed porous element 26 to be mixed with the foamable liquid and discharged as foam through the nozzle 24. Upon release of the bottle collapsing force to create a low pressure condition in the bottle interior, air will pass through the opening 36, past the ball check 32 and through the dip tube 28 to the bottle interior. While it is possible to operate the unit 12 with the bottle 14 in an upright orientation, such that air is discharged directly through the porous block 26 and liquid through the dip tube 28, such operation results in air being returned through the dip tube and bubbling up through the liquid. This has the effect of creating unwanted bubbles in the bottle interior which could be an impediment to the passage of air directly through the porous block, particularly with foamable liquids having a high surface tension. In either case, the passage of air and liquid through the interstices of the porous block 26 will cause the necessary turbulent intermixing of air and liquid so that the mixture will emerge from the porous block 26 and nozzle 24 as foam.

It is known in the foamer art that the consistency of foam developed by mixing air and liquid in the manner described will vary with such foamable liqid parameters as viscosity and surface tension and with mixing parameters such as the velocity of liquid and air flow during mixing and the length of the medium in which mixing takes place. Both of these latter factors are affected in some measure by the discharge pressure which, in manually actuated foamers, is necessarily limited. Hence it is important in manual foam dispensers that the porosity and length of a mixing medium, such as the porous element 26, be correlated closely with the particular foamable liquid to be used. The porosity of the fixed element 26 can be altered by selecting appropriate materials from which it is made and also, the effective length of the porous element through which the air and liquid pass can be varied by increasing the length outwardly of the valve seat 34. Increasing the length of the porous element outwardly of the valve seat 34, however, necessarily increases the length of the air return passageway 36 which, when filled with fooam, represents a less than ideal passageway for the return of air to the interior of the bottle. In addition, the accomodation of varying characteristics in the fixed porous element 26, which represents a component in a preassembled subassembly, necessitates large manufacturing inventories of such subassemblies.

In accordance with the improvement provided by the present invention, a floating porous element 38 is provided in the nozzle 24 between the fixed porous element 26 and the discharge opening at the small end 39 of the nozzle. In the embodiment of FIGS. 1 and 2, the porous element is of generally cup-shaped configuration and as such, is formed with a base portion 40, an intermediate frusto-conical portion 42 having an angle of convergence greater than that of the nozzle, and an open cylindrical portion 44. The cylindrical portion 44 and conical portion 42 thus merge or join to establish a line-type sealing ridge 46 on its exterior surface to engage or seat against the interior conical surface of the nozzle 24 as shown by solid lines in FIG. 2. The diameter of the sealing ridge 46 is selected to be larger than the small open end 39 of the nozzle 24 but smaller than the diameter of the nozzle at the outer face of the fixed element 26 so that the floating element 38 may move from a seated position, shown in solid lines in FIG. 2, to an unseated air return position illustrated in phantom lines in this figure. The open end of the cylindrical portion 44 is provided with notches 47 or the like to enable air to pass about the floating member 38 to the return passage 36 in the fixed element 26 when the two porous elements are in contact with each other.

The material from which the floating element 38 is formed may be the same as that from which the fixed element 26 is formed, it being preferred that both be of a sintered polymeric material as disclosed in the aforementioned co-pending application. Although it is contemplated that the porosity of the respective elements 26 and 40 may differ, it is preferred that the operating parameters of the foaming unit 12 be determined or regulated by a choice in the wall thickness of the floating member 38. In this respect, the function served by the floating member 38 is principally the provision of an additional increment of porous media through which the air and foamable liquid pass before being discharged from the nozzle as foam. In other words, foam passing from the fixed element 26 in the manner described above is likely to be liquid rich and characterized as having relatively large bubble sizes. Upon passing through the floating element 38, however, bubble size in the foam is reduced sufficiently so that the foam passing out of the nozzle opening 39 will be drier or stiffer than that passing from the fixed element 26. Correspondingly, the thicker the walls of the element 38, the larger the increment of bubble size reduction will be. It is contemplated, for example, that the base 40 in the floating element as well as the frusto-conical wall portions 42 may be thickened considerably or the member 38 may be solid for certain types of liquids.

Figure 3:
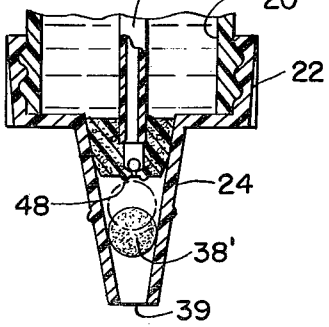
FIG. 3 is a view similar to FIG. 2 but at a smaller scale and illustrating an alternative embodiment of the invention.

Alternatively, the floating element may be a solid porous sphere or ball 38' as shown in the embodiment of FIG. 3. In this instance, the outer end of the fixed element 26 is provided with raised and spaced dimples 48 or other such means to prevent seating of the ball 38' against the air return passageway 36.

Operation of the floating element 38 during the discharge of foam is believed apparent from the preceding description. It is to be noted that during the portion of the foaming cycle during which the discharge pressure is released from the receptacle 14, thus bringing about a return of air to the bottle interior for restoration to its initial shape for a subsequent foam dispensing cycle, the floating element 38 moves against the fixed element 26 and has the effect of breaking up the foam which exists between the outer end of the fixed element 38 and the opening of the nozzle 24. Hence, the presence of the floating element 38 augments the return passage of air to the bottle interior.

Thus, it will be appreciated that by this invention, an improved foamer nozzle is provided by which the aforementioned objectives are completely fulfilled. Not only is the operation of the foaming unit 12 improved, but the foamer may be adapted to a particular foamable liquid merely by selection of the appropriate floating element 38. With light foamable liquids of low viscosity and surface tension where it is important that the length of travel of the foamable liquid and air through porous materials should be increased, the element 38 shown in FIG. 2 may be of increased wall thickness or a solid member. Also, the ball 38' shown in FIG. 3 might be used in these circumstances. Where relatively heavier foamable liquids are used, the thin walled cup-like configuration of the element 38 shown in FIG. 2 may be used. It is clear that in the manufacturing assembly of foamers, an inventory only of various types of the floating element 38 may be needed to adapt the assembled units to varying types of foamable liquids.

In light of the foregoing description, it will be apparent to those skilled in the art that various modifications and/or changes may be made in the illustrated embodiments of the invention without departure from the inventive concept. It is expressly intended, therefore, that the foregoing is descriptive only of preferred embodiments, not limiting, and that the true spirit and scope of the present invention be determined by reference to the appended claims.

I claim:

1. In a low pressure foam generating and dispensing device having a receptacle for containing foamable liquid and air, a nozzle near one vertical extremity of the receptacle and having internal surfaces to define a discharge passageway open at one end to the receptacle interior and to a foam discharging opening at its other end, at least a portion of the discharge passageway being defined by an outwardly converging frusto-conical interior surface, a mixing subassembly connected to the one end of the discharge passageway and having an imperforate tube extending to and opening near the other vertical extremity of the receptacle, and a one-way air return passage operative to pass air into the receptacle upon a reduction of pressure within the receptacle to below atmospheric pressure, the improvement comprising:

a movable form sustaining porous element positioned in the discharge passageway between the mixing subassembly a frusto-conical portion of the discharge passageway, said movable porous element being larger than the small end of the frusto-conical portion and smaller than the transverse area of the discharge passageway at the mixing subassembly, whereby said movable porous element moves against the internal frusto-conical surfaces of the nozzle upon discharge of a foamable liquid and air mixture from the receptacle to cause passage of the discharged mixture through the movable porous element and whereby the movable porous element moves toward the mixing subassembly to allow air to return to the interior of the receptacle around said movable porous element and through the air return passage.

2. The apparatus recited in claim 1 wherein said movable porous element is a frusto-conical exterior configuration the surfaces of which converge at an angle greater than that of the frusto-conical interior surface of the nozzle.

3. The apparatus recited in claim 2 wherein said movable porous element is of cup-shaped configuration having a frusto-conical wall portion closed by a base at the small end thereof.

4. The apparatus recited in claim 3 including an open cylindrical portion merging with the large end of said frusto-conical wall portion, said cylindrical portion having notches formed therein for return air passage.

5. The apparatus recited in claim 1 wherein said movable element is spherical.

6. In a low pressure foam generating and dispensing device having a receptacle for containing foamable liquid and air, a nozzle near one vertical extremity of the receptacle and having internal surfaces to define a discharge passageway open at one end to the receptacle interior and to a foam discharging opening at its other end, at least a portion of the discharge passageway being defined by an outwardly converging frusto-conical interior surface, a stationary porous element mounted in and closing the one end of the discharge passageway and having an air return port extending therethrough, an imperforate tube connected at one end to the return port and opening at its other end near the other vertical extremity of the receptacle, and a ball check in the air return port operative to block fluid flow from the receptacle through the port but to pass air into the receptacle so that an increase of pressure within the receptacle will force foamable liquid and air through the stationary porous element to the discharge passageway and so that a reduction of pressure within the receptacle to below atmospheric pressure will cause air to return to the receptacle, the improvement comprising:

a movable form sustaining porous element positioned in the discharge passageway between the stationary porous element and a frusto-conical portion of the discharge passageway, said movable porous element being larger than the small end of the frusto-conical portion and smaller than the transverse area of the discharge passageway at the stationary porous element, whereby said movable porous element moves against the internal frusto-conical surfaces of the nozzle upon discharge of a foamable liquid and air mixture from the receptacle to cause passage of the discharge mixture through the movable porous element and whereby the movable porous element moves toward the stationary porous element to allow air to return to the interior of the receptacle around said movable porous element and through the air return port.

7. The apparatus recited in claim 6 including means to prevent blockage of the air return port in the stationary porous element by said movable porous element.

8. A hand actuated foam generating and dispensing device comprising in combination:

a collapsible bottle for containing foamable liquid and air, said bottle having an externally threaded mouth at one end thereof;

a cap element having an internally threaded skirt portion for engaging the threads on said bottle mouth and a frusto-conical discharge nozzle having a large diameter inner end and a relatively small opening at its outer end;

a stationary porous element mounted in the large end of the nozzle and having a concentric air return port therein;

an imperforate dip tube connected at one end to said stationary porous element and opening at its other end near the end of the bottle opposite said mouth, said one end of said dip tube forming one end of a valve chamber in said stationary porous element, said valve chamber communicating at its other end through a seat with said air return port;

a ball check in said valve chamber operative to block fluid flow from the receptacle through said air return port but to pass air into the receptacle through said dip tube upon a reduction of pressure within the bottle below atmospheric; and a movable form sustaining porous element position in said nozzle between said stationary porous element and the outer end of said nozzle, said movable porous element having an effective diameter larger than the small end of the nozzle and smaller than the transverse area of the interior nozzle passage at said stationary porous member, whereby said movable porous element moves against the internal frusto-conical surfaces of the nozzle upon discharge of foam through said stationary porous element and against said stationary porous element to allow air to return to the interior of said receptacle around said movable porous element and through said air return port.

9. The apparatus recited in claim 8 wherein both said porous members are formed of a sintered polymeric material.

10. The apparatus recited in claim 9 wherein said movable porous member is of cup-shaped configuration.

11. The apparatus recited in claim 9 wherein said movable porous member is a solid sphere.

* * * * *

UNITED STATES PATENT AND TRADEMARK OFFICE

CERTIFICATE OF CORRECTION

PATENT NO. : 4,044,923

DATED : August 30, 1977

INVENTOR(S) : Jack C. Gardner

It is certified that error appears in the above-identified patent and that said Letters Patent are hereby corrected as shown below:

Column 1, line 24, change "it" to --its--.

Column 4, line 1, change "liqid" to --liquid--;

Line 19, change "fooam" to --foam--.

Column 6, line 8, after "subassembly", insert --and--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*